United States Patent [19]

Johnson et al.

[11] Patent Number: 4,643,503

[45] Date of Patent: Feb. 17, 1987

[54] FLUORESCENT LAMP MOUNTING SYSTEM

[75] Inventors: George E. Johnson, Bronxville; Walter Newman, Bayside, both of N.Y.

[73] Assignee: Leviton Manufacturing Company, Inc., Little Neck, N.Y.

[21] Appl. No.: 790,662

[22] Filed: Oct. 28, 1985

[51] Int. Cl.[4] ..... H01R 33/08; H01R 33/97; H01R 13/62

[52] U.S. Cl. ..... 339/50 R; 339/54; 339/91 R

[58] Field of Search ..... 339/50 R, 53, 54, 75 M, 339/91 R

[56] References Cited

U.S. PATENT DOCUMENTS

| | | | |
|---|---|---|---|
| 2,254,706 | 9/1941 | Mueller | 339/54 |
| 2,349,255 | 5/1944 | Epstein | 339/54 X |
| 3,192,500 | 6/1965 | West | 339/91 R |

FOREIGN PATENT DOCUMENTS

| | | | |
|---|---|---|---|
| 461907 | 7/1928 | Fed. Rep. of Germany | 339/54 |
| 953370 | 11/1956 | Fed. Rep. of Germany | 339/50 R |
| 626834 | 7/1949 | United Kingdom | 339/54 |

*Primary Examiner*—E. Michael Combs
*Attorney, Agent, or Firm*—Paul J. Sutton

[57] ABSTRACT

A mounting system for a U-shaped tube of a fluorescent lamp that has a free end and a connecting end having a coupling member that holds the two tube portions together. The connecting end has male electrical prongs that are insertable into female electrical receptacles formed in a body wall of a mounting body. The body wall is transverse to the U-tube. A support member extends outwardly from under the mounting body under the coupling member to provide resistance to downward movement of the U-tube. A wire locking member connected to the mounting body extends over the coupling member and includes a cross-wire having a U-portion that clamps against the outer wall of the mounting member between the two tube portions so as to grip the U-tube and prevent it from laterally sliding from the mounting body. The locking member also acts to prevent sideways movement of the U-tube in one direction when the U-tube is set vertically.

11 Claims, 6 Drawing Figures

FLUORESCENT LAMP MOUNTING SYSTEM

BACKGROUND OF THE INVENTION

The present system relates to mounting a fluorescent lamp and in particular U-shaped fluorescent tube.

A U-shaped tube of a fluorescent tube is mounted only at the electrically connected ends of the U-tube while the closed end is unsupported. The U-tube is adapted to both vertical and horizontal positioning. U-tubes have a number of decorative and practical uses. The unsupported end of the U-tube creates by nature an unstable connection at the mounted end in either a horizontal or vertical mounting. One problem is that the electrical prongs of the fluorescent lamp can slide comparatively easily from their receptacles at the supported end by external pressure as compared to the secure opposed end mounting of the common tube. Another problem is that the entire U-tube as a unit is not securely held at the supported end in either horizontal or vertical orientations. These problems are exacerbated by the fact that the U-tube is cantilevered so as to place additional stress at the connected end, which tends to make the connection even more uncertain.

SUMMARY OF THE INVENTION

The present invention provides a system for mounting a fluorescent U-tube which overcomes the problems of securely mounting the U-tube as set forth above.

Accordingly, it is an object of this invention to provide a mounting system for a U-tube for a fluorescent lamp which prevents the U-tube from being moved laterally from the mount in either vertical or horizontal positions.

It is another object of this invention to provide a mounting system for a fluorescent U-tube that both provides a counterforce against the cantilever force in the U-tube and also prevents lateral movement of the U-tube from the mount. Thus maintaining the integrity of the electrical connection in either vertical or horizontal positions.

The present invention fulfills the above objects and overcomes the limitations and disadvantages of prior art by providing a mounting system for a U-shaped tube of a fluorescent lamp. The U-tube has opposed connecting and free ends, the connecting end having male electrical contacts adapted to be mounted to a mounting body connect to the surface of a base such as a wall. The mounting body has a body wall having opposed inner and outer surfaces relative to the connecting end of the U-tube, the mounting body forming female receptacles at the inner surface adapted to receive the male prongs of the U-tube. A support member connected to the mounting body extends from the bottom of the body under a coupling member at the connecting end of the U-tube to provide support against downward transverse movement of the U-tube caused by gravitational force, particularly a levered gravitational force at the free end of the U-tube. A locking wire member connected to the mounting body is adapted to clamp against the top side of the coupling member, which is adapted to hold the two parallel tube portions together. The coupling member has opposed inner and outer walls relative to the mounting body and parallel to the inner surface of the body wall of the mounting body. The locking wire member includes spaced parallel connecting wire portions extending to spaced, parallel supporting wire portions that are cross-connected by a cross-wire portion having a central U-portion that clamps against the outside surface of the coupling member. The connecting wire portions extend through a slot or slots formed through the body wall of the mounting body to right-angle wire clamps so that they lock against the outer surface of the body wall. The U-tube is thus prevented from lateral movement away from the mounting body by the wire locking member. The wire locking member is biasable so that the connecting arms are biasedly pressed apart at the side edges of the slots in the body wall and are increasingly biased as they are pressed together in the slots. The U-tube can be set vertically upright or vertically hung so that the supporting wire portions act to prevent side ways transverse movement of the U-tube in a direction opposite to that exerted by the force of gravity when the U-tube is set horizontally.

My invention will be more clearly understood from the following description of a specific embodiment of the invention together with the accompanying drawings.

Reference is now made in detail to the drawings wherein similar reference characters denote similar elements throughout the several views.

Figure 3:
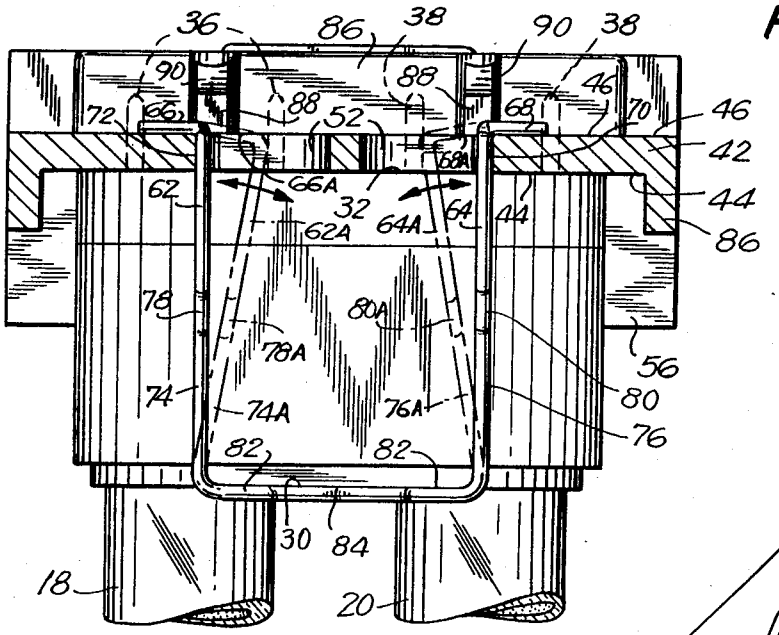
FIG. 3 is a view taken through line 3—3 of FIG. 2.
Figure 4:
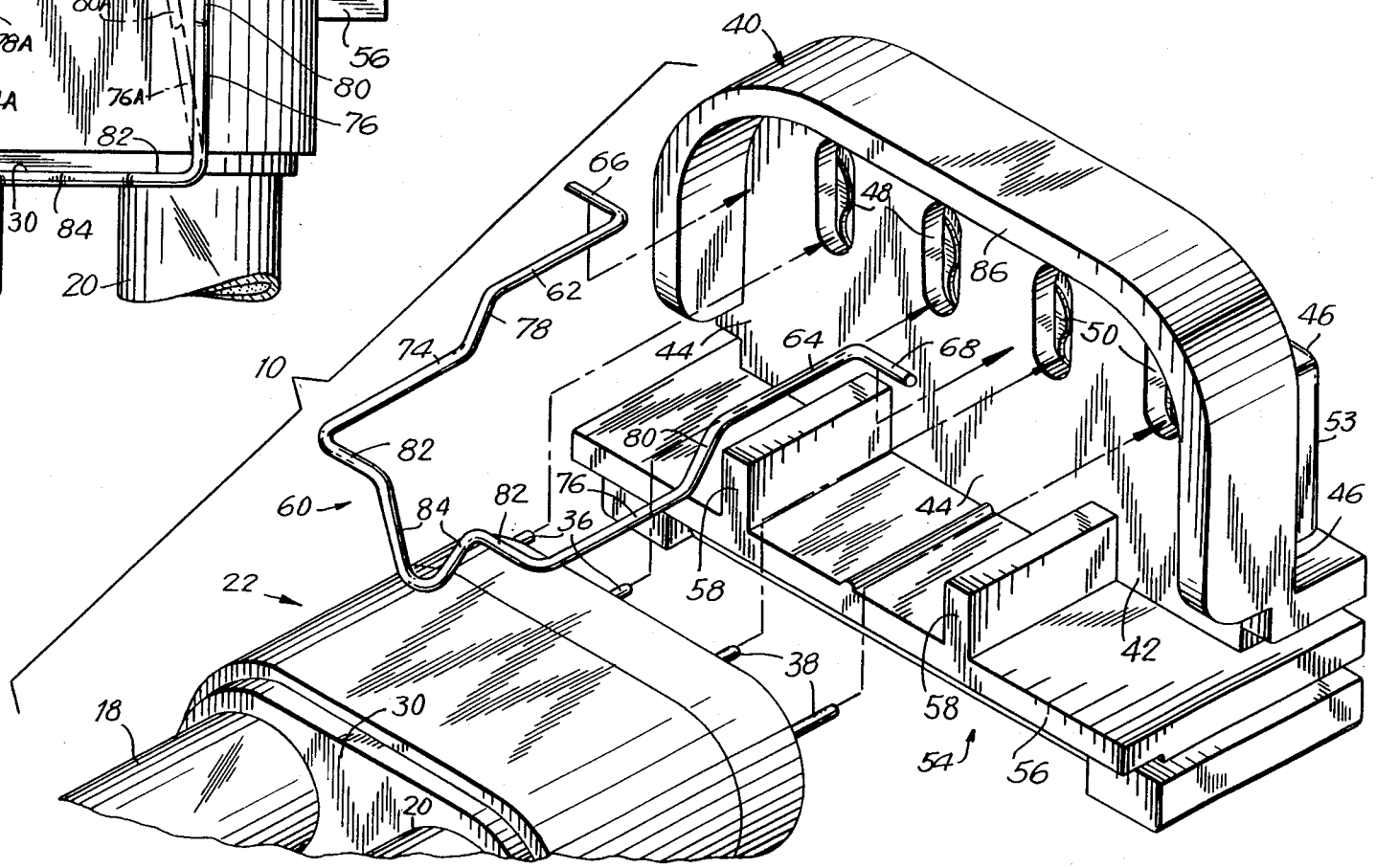
FIG. 4 is an exploded perspective view of the mounting system.

A mounting system 10 for a U-shaped fluorescent tube 12, hereinafter referred to as U-tube 12, is shown in foreshortened perspective view in FIG. 1. U-tube 12 has a connecting end 14 and an opposed free end 16. U-tube 12 includes two parallel, slightly spaced, tube portions 18 and 20 connected at free end 16 in a U-bend. U-tube 12 includes a coupling member 22 at connecting end 14 which is adapted to hold tube portions 20 and 22 in non-movable alignment. Coupling member 22 includes opposed cross-walls 24 and 26, seen best in FIG. 2, that extend across opposite sides of tube portions 18 and 20. Coupling member 22 also includes opposed inner and outer walls 28 and 30, seen best in FIGS. 3 and 4, which are generally transverse to cross-walls 24 and 26. Inner and outer walls 28 and 30 intersect with cross-walls 24 and 26. Opposed, semi-cylindrical end walls 32 and 34 encircle the outside areas of tube portions 18 and 20 and join cross-walls 24 and 26. Cross-wall 24 is shown as the upper wall and cross-wall 26 as the lower wall in the embodiment of FIGS. 1–5. The primary area of outer wall 30 is defined between the areas of penetration of tube portions 18 and 20 through outer wall 30. Inner wall 28 grips two pairs of male electrical connecting prongs 36 and 38 which are electrically connected to the ends of tube portions 18 and 20, respectively, as seen in FIG. 4.

Mounting system 10 includes a mounting body 40 which is adapted to hold U-tube 12. Mounting body 40 includes a body wall 42 having opposed inner and outer surfaces 44 and 46, respectively, with inner surface 44 being generally transverse to the direction of orientation of U-tube 12 and generally parallel to inner wall 28 of coupling member 22. Wall 42 forms two pairs of female electrical receptacles 48 and 50 aligned in a row lateral upper and lower cross-walls 24 and 26 at inner surface 44 adapted to receive prong pairs 36 and 38, respectively, so as to electrically connect U-tube 12 with an external power source (not shown). Mounting body 40 holds electrical contacts (not shown) known in the art of fluorescent lamps that are connected to the power source. A general mounting portion 53 is positioned at outer surface 46 for connection to electrical leads and to a vertical base wall (not shown). As will be discussed, U-tube 12 can be mounted vertically either upright or hung besides being mounted horizontally as shown.

Body wall 42 forms a pair of elongated mating slots 52 at the upper portion of body wall 42 at a position slightly spaced upward from the plane of upper cross-wall 24 and from female receptacles 48 and 50.

Mounting body 40 includes a support member 54 comprising a support wall 56 extending generally perpendicularly, or transversely, from body wall 42 to a position spaced directly from, or below, lower cross-wall 26. Support member 54 also includes a pair of spaced, parallel support members 58 connected to support wall 56 extend through the space between cross-wall 26 and support wall 56 to bearing contact with lower cross-wall 26. The bearing surfaces of support members 58 are in the same plane with lower cross-wall 26.

Mounting system 10 includes a wire locking member 60 that includes a biasable pair of spaced, generally parallel connecting wire portions 62 and 64 that extend through both slots 52 transverse to body wall 42. A pair of hold-down wire portions 66 and 68 connected to wire members 62 and 64 are transverse to connecting wire portions 62 and 64 and outer surface 46 of body wall 42 and are in gripping contact with outer surface 46 of body wall 42. Connecting wire portions 62 and 64 are biased outwardly so as to be pressed against the opposed outer edges 70 and 72 respectively, of slots 52.

Wire locking member 60 includes a supporting portion that includes a pair of spaced, generally parallel supporting wire portions 74 and 76 that extend from connecting wires 62 and 64, respectively, laterally aligned with tube portions 18 and 20, respectively, across upper cross-wall 24 of coupling member 22. In the horizontal alignment of U-tube 12 shownin FIGS. 1–5, supporting wire portions 74 and 76 are adapted to press to some degree against upper cross-wall 24, and also, as will be discussed later, in a vertical alignment of U-tube 12 shown in FIG. 6, supporting wire portions 74 and 76 are capable of being in pressing contact with upper cross-wall 24. Supporting wire portions 76 and 78 are proximate to the plate of upper cross-wall 24 while connecting wire portions 62 and 64 extend from body wall 42 in a plane spaced above upper cross-wall 42. A pair of angled joining wire portions 78 and 80 connect connecting wire portion 62 to supporting wire portion 74 and connecting wire portion 64 to supporting wire portion 76, respectively.

Wire locking member 60 also includes a cross-wire portion 82 transverse to and connecting with supporting wire portions 74 and 76. Cross-wire portion 82 includes a center wire portion 84 that extends downwardly between tube portions 18 and 20 in pressing, clamping association with outer wall 30. Center wire portion 84 extends downwardly in a general "U" configuration, the bottom of the "U" being curved.

Body wall 42 includes a rim flange 86 that extends inwardly from inner surface 44 from and transverse to the upper and side edge portions of body wall 42, that is, the top portion of rim flange 86 is coextensive with the top edges of slots 52. A pair of keeper members 88 extend outwardly from outer surface 46 of body wall 42 adjacent to the bottom edge of slots 52 generally opposed to rim flange 86 at slot outer edges 70 and 72. Connecting wire portions 62 and 64 extend through slots 52 at outer edges 70 and 72 so as to be in bracing contact with both rim flange 86 on the top side and keeper member 88 on the bottom side so as to prevent upward movement of wire locking member 60.

Another pair of keeper members 90 extend outwardly from outer surface 46 of body wall 42 at the top edges of slots 52 at the outer edges 70 and 72 opposite keeper members 88 which are in contact with connecting wire portions 62 and 64 so as to prevent movement of wire locking member 60 in a downward direction.

As seen in FIG. 4, locking wire member 60 is biasable and mounted to mounting body 40 through slots 52 by squeezing the opposed parallel connecting wire portions 62 and 64 together to positions 78A and 80A shown in phantom line so that hold-down wire portions 66 and 68 move to positions 66A and 68A to clear outer edges 70 and 76 of slots 52. Once portions 66A and 68A clear slots 52, connecting wire portions 62A and 64A are released to be self-biased back to positions 62 and 64 and locked to mounting body 40 at slots 52.

Figures 1, 2:
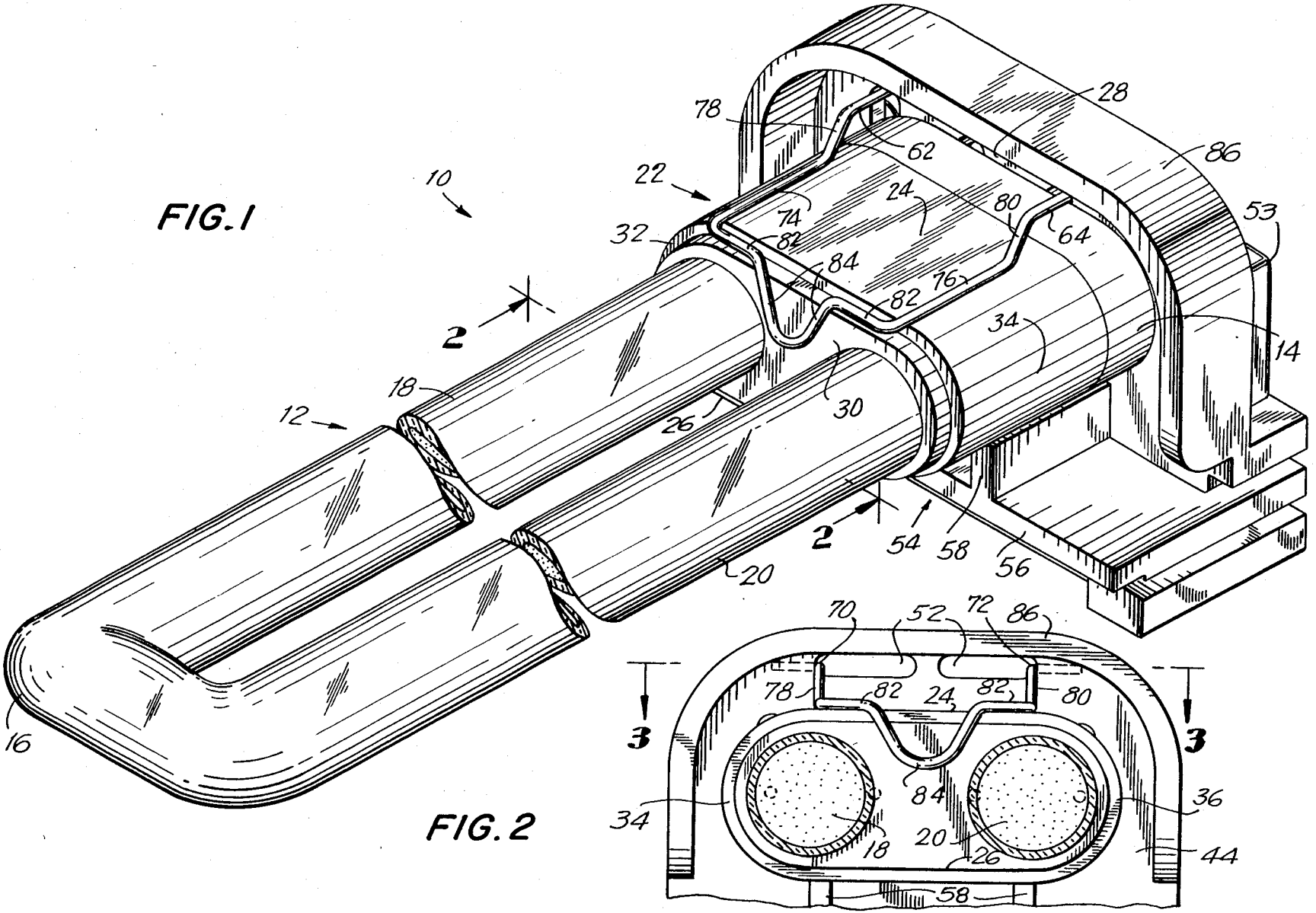
FIG. 1 is a perspective view of the mounting system.
FIG. 2 is a view taken through plane 2—2 of FIG. 1.

As seen best in FIG. 1, although the primary upward support for U-tube 12 is support members 54, additional cooperative support to prevent transverse movement of U-tube 12 relative to mounting body 40 is given by the clamping, or locking, forces by wire locking member 60 at center wire portion 84. That is, if U-tube 12, tends to lever itself so as to cause transverse movement from mounting body 40 by the unbalanced downward gravity force at free end 16, center wire portion 84 cooperates with support member 54 to prevent such tilting, or transverse movement, of U-tube 12 in a downward direction.

Figure 6:
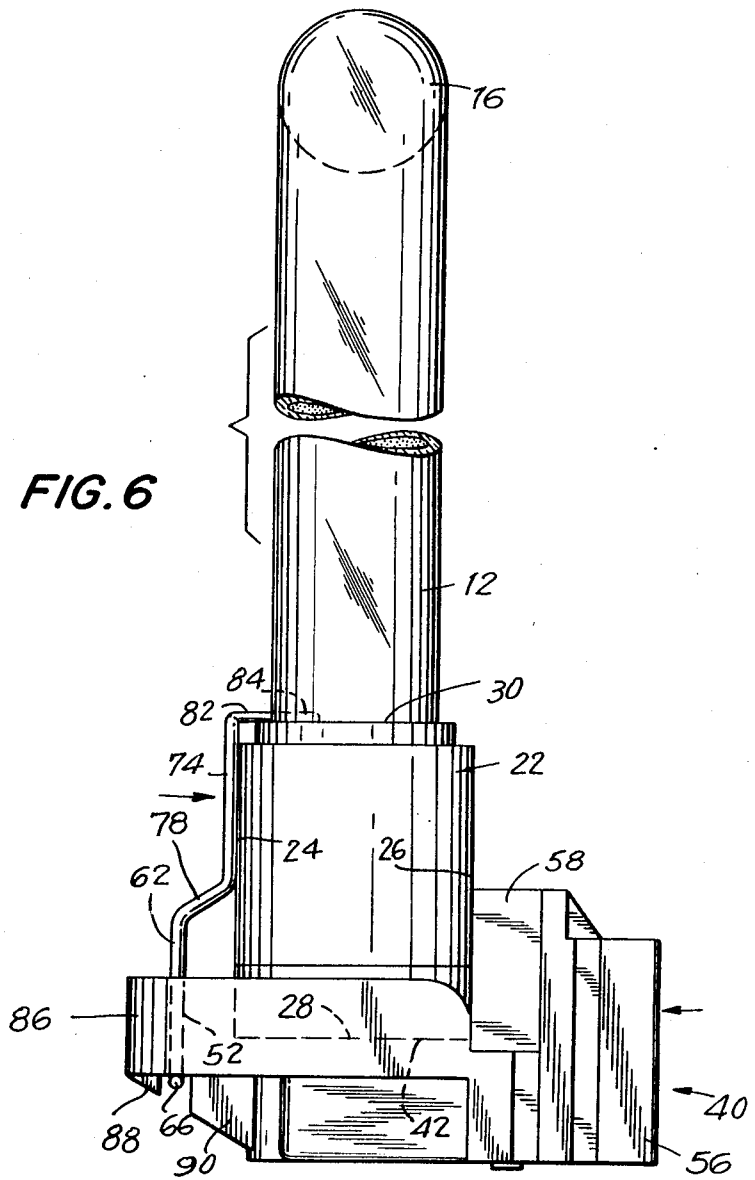
FIG. 6 is a side view of the mounting system in an upright vertical position.
Figure 5:
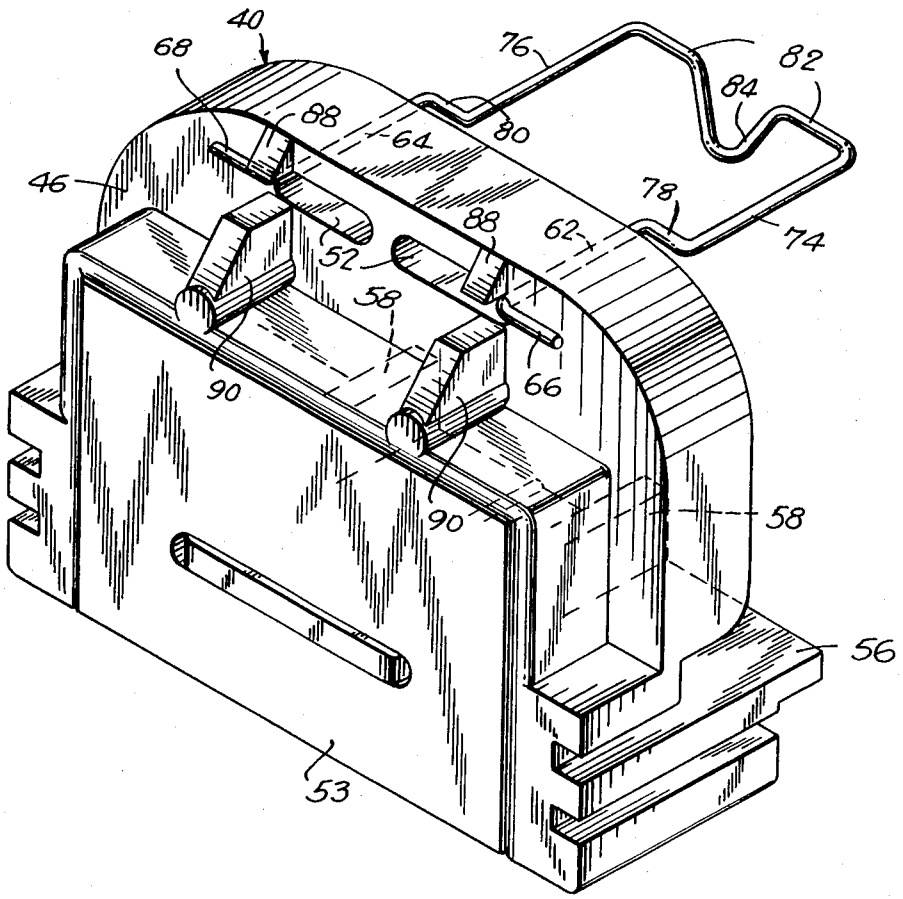
FIG. 5 is a rear perspective view of the mounting system.

The embodiment of the invention described so far relates to U-tube 12 being in a generally horizontal position. U-tube 12 can, however, be oriented in other directions, typical being in a vertical direction as shown in FIG. 6, where the reference numerals are the same as for FIGS. 1–5. An additional feature of mounting system 10 is revealed in the vertical position. Specifically, it can be seen that U-tube 12 can be subjected to leverage from mounting body 40 by way of tilting forces against supporting wire portions 74 and 76 (seen as supporting wire portion 74) so that supporting wire portions 74 and 76 either alone or in cooperation with the wedging position of support member 54 prevent transverse movement of U-tube 12 in an outward direction in response to the tilting force. It is noted that this last outward direction is opposite the downward direction of force generally discussed relative to FIGS. 1–5.

The embodiment of the present invention particularly disclosed herein is presented merely as an example of the invention. Other embodiments, forms, modifications, and variations of the invention set forth here coming within the proper scope of the appended claims will, of course, readily suggest themselves to those skilled in the art.

What is claimed is:

1. A mounting system for a U-shaped tube of a flourescent lamp, comprising, in combination, said U-tube having opposed connecting and free ends, said connecting end having male electrical contacts, body means connected to a surface, said body means being for mounting said U-tube at said connecting end and for providing female electrical contacts adapted to receive said male contacts, said body means also being for providing electrical contacts between said female contacts and a source of electrical power, support means connected to said body means for inhibiting transverse movement of said U-tube at said body means in a first direction relative said body means when said U-tube is in a generally horizontal or vertical position, and locking means connected to said body means and removably clamped to said connecting end of said U-tube, said locking means being for preventing lateral movement of said U-tube away from said body means and the movement of said male electrical contacts away from said female electrical contacts wherein, said locking means is also for cooperating with said support means for preventing tranverse movement of said U-tube in said first direction and for preventing transverse movement of said U-tube in a second direction opposite said first direction when said U-tube is in a generally vertical position and, said U-tube includes two parallel, slightly spaced tube portions and said U-tube further includes a coupling member at said connecting end adapted to hold said two tube portions in non-movable alignment, said locking means being in removable locking association with said coupling member and wherein, said coupling member includes a first and a second cross-wall, said cross-walls are opposed and extend across opposite sides of said two tube portions, and further includes opposed inner and outer wall relative said body means generally transverse to the parallel tubes and generally transverse to an intersecting said cross-walls, said locking means connected to said body means and is generally transverse to the inner and outer walls and neighboring with the first cross-wall and is adapted to clamp against said outer wall of said coupling member, whereby lateral movement of said U-tube relative said body means is prevented, said body means is a mounting body including a body wall generally transverse to said U-tube and generally parallel to said inner wall of said coupling member, said body wall forming two pairs of female receptacles, said connecting ends having two pairs of male prongs positioned at each end of said two tube portions adapted to be received by said two pairs of receptacles.

2. A mounting system for claim 1, wherein said support means includes a support member connected to and extending generally perpendicular from said body wall to a position in supportive contact with the said second cross-wall of said coupling member, whereby transverse movement of said U-tube in said first direction is inhibited.

3. A mounting system for claim 2, wherein said body wall has opposed inner and outer surfaces relative said U-tube and forms slot means opening on the inner and outer surfaces of the wall, generally aligned with the first cross-wall of said coupling member, said locking means being a locking member having a connection portion positioned through slot means at the outer surface of said body wall, said slot means being for providing gripping capability for said locking member with said mounting body.

4. A mounting system according to claim 3, wherein said locking member includes a supporting portion adjacent said connecting portion and where it neighbors with said first cross-wall, in supportive contact with said first cross-wall, adapted for pressing to some degree against the first cross-wall of said coupling member wherein transverse movement of said U-tube in said second direction is prevented in cooperative association with said support member in supportive contact with the second cross-wall.

5. A mounting system according to claim 4, wherein said outer wall of said coupling member includes a center wall portion extending between said spaced two tube portions, and said locking member includes a clamping portion adjacent said supporting portion, said clamping portion adjacent being in clamping association with said center wall portion, said clamping portion being adapted to prevent lateral movement of said U-tube in said first direction in cooperative association with said support member and to prevent lateral movement of said U-tube away from said mounting body.

6. A mounting system according to claim 5, wherein said locking member is a wire locking member, wherein said connecting portion includes a pair of spaced, generally parallel, connecting wire portions through said slot means transverse to said body wall and further includes a pair of hold-down wire portions transversely connected to said pair of connecting wire portions transverse to said outer surface of said body wall in gripping contact with said outer surface, said pair of connecting wire portions being biasedly outwardly pressed against said outer wall in said slot means.

7. A mounting system according to claim 6, wherein said supporting portion of said wire locking member includes a pair of generally parallel supporting wire portions transverse to said bdoy wall and extending from said pair of said connecting wire portions across said first cross-wall of said coupling member; said pair of supporting wire portions being in supportive contact with said first cross-wall so as to prevent transverse movement of said U-tube in said second direction when said U-tube is in a generally vertical position.

8. A mounting system according to claim 7, wherein said clamping portion of said wire locking member includes a cross-wire portion transverse to and connecting said pair of supporting wire portions, said cross-wire portion including a center, generally U-configured portion in pressing clamping association with said center wall portion of said coupling member.

9. A mounting system according to claim 8, wherein said support member includes a support wall spaced from said second cross-wall and a pair of support members spaced along the support wall and transverse to the second cross-wall, connected to said support wall, said pair of support members being in bearing contact with said second cross-wall of said coupling member.

10. A mounting system according to claim 9, wherein said body wall includes a rim flange extending toward said coupling member from the inner surface of said body wall, and said slot means includes at least one elongated slot having opposed side edges formed by said body wall adjacent said rim flange, said body member including a pair of first keeper members extending outwardly from said outer surface of said body wall adjacent to said slot and generally opposed to said rim flange, said pair of connecting wire portions extending through said slot side edges and being in bracing contact with both said rim flange on one side and said pair of first keeper members on the opposite side so as to prevent movement of said locking member in said second direction.

11. A mounting system according to claim 10, wherein said body wall includes a pair of second keeper members spaced opposite said pair of first keeper members, said second keeper members being in contact with said pair of connecting wire portions so as to prevent movement of said locking member in said first direction.

* * * * *